US010837748B2

(12) United States Patent
Kautzsch

(10) Patent No.: US 10,837,748 B2
(45) Date of Patent: Nov. 17, 2020

(54) DEVICE FOR PRODUCING AN ARMING CRITERION, FUZE AND MUNITION

(71) Applicant: DIEHL DEFENCE GMBH & CO. KG, Ueberlingen (DE)

(72) Inventor: Karl Kautzsch, Schwanstetten (DE)

(73) Assignee: Diehl Defence GmbH & Co. KG, Ueberlingen (DE)

( * ) Notice: Subject to any disclaimer, the term of this patent is extended or adjusted under 35 U.S.C. 154(b) by 0 days.

(21) Appl. No.: 16/434,697

(22) Filed: Jun. 7, 2019

(65) Prior Publication Data

US 2020/0025543 A1 Jan. 23, 2020

(30) Foreign Application Priority Data

Jun. 7, 2018 (DE) ..... 10 2018 004 510

(51) Int. Cl.
*F42C 15/40* (2006.01)
*F42C 15/26* (2006.01)

(52) U.S. Cl.
CPC ..... *F42C 15/40* (2013.01); *F42C 15/26* (2013.01)

(58) Field of Classification Search
CPC ..... F42C 15/00; F42C 15/24; F42C 15/40; F42B 10/26
See application file for complete search history.

(56) References Cited

U.S. PATENT DOCUMENTS 4,800,814 A * 1/1989 Holt ..... F42B 10/06 102/226
5,115,742 A * 5/1992 Frazer ..... F42C 15/40 102/206
7,584,922 B2 9/2009 Baer et al.
8,113,118 B2 * 2/2012 Schmidt ..... F42C 15/40 102/237
8,381,650 B2 2/2013 Glatthaar et al.
2006/0107862 A1 5/2006 Davis et al.
2008/0237391 A1 10/2008 Mock et al.
2008/0302906 A1 * 12/2008 Bar ..... F42B 10/64 244/3.22
2015/0247715 A1 9/2015 Wurzel et al.

FOREIGN PATENT DOCUMENTS

DE 10341713 B3 6/2005
DE 102006057229 A1 6/2008
DE 102007054777 B3 8/2009
EP 0228783 B1 9/1991
EP 1930686 A1 6/2008
WO 2008108869 A2 9/2008
WO 2014102765 A1 7/2014

* cited by examiner

*Primary Examiner* — J. Woodrow Eldred

(74) *Attorney, Agent, or Firm* — Laurence A. Greenberg; Werner H. Stemer; Ralph E. Locher

(57) ABSTRACT

A device produces an arming criterion for a fuze for a partly spinning munition. The munition has a first part which spins and a second part without or with little spin during flight of the munition. The device includes a sensor for outputting a characteristic variable for a relative rotation between the first part and the second part and a control unit for producing the arming criterion when the characteristic variable fulfils a flying criterion. The fuze for the partly spinning munition, which has at least one arming criterion, includes the device for providing the arming criterion or one of the arming criteria. The partly spinning munition includes the fuze with the device.

15 Claims, 1 Drawing Sheet

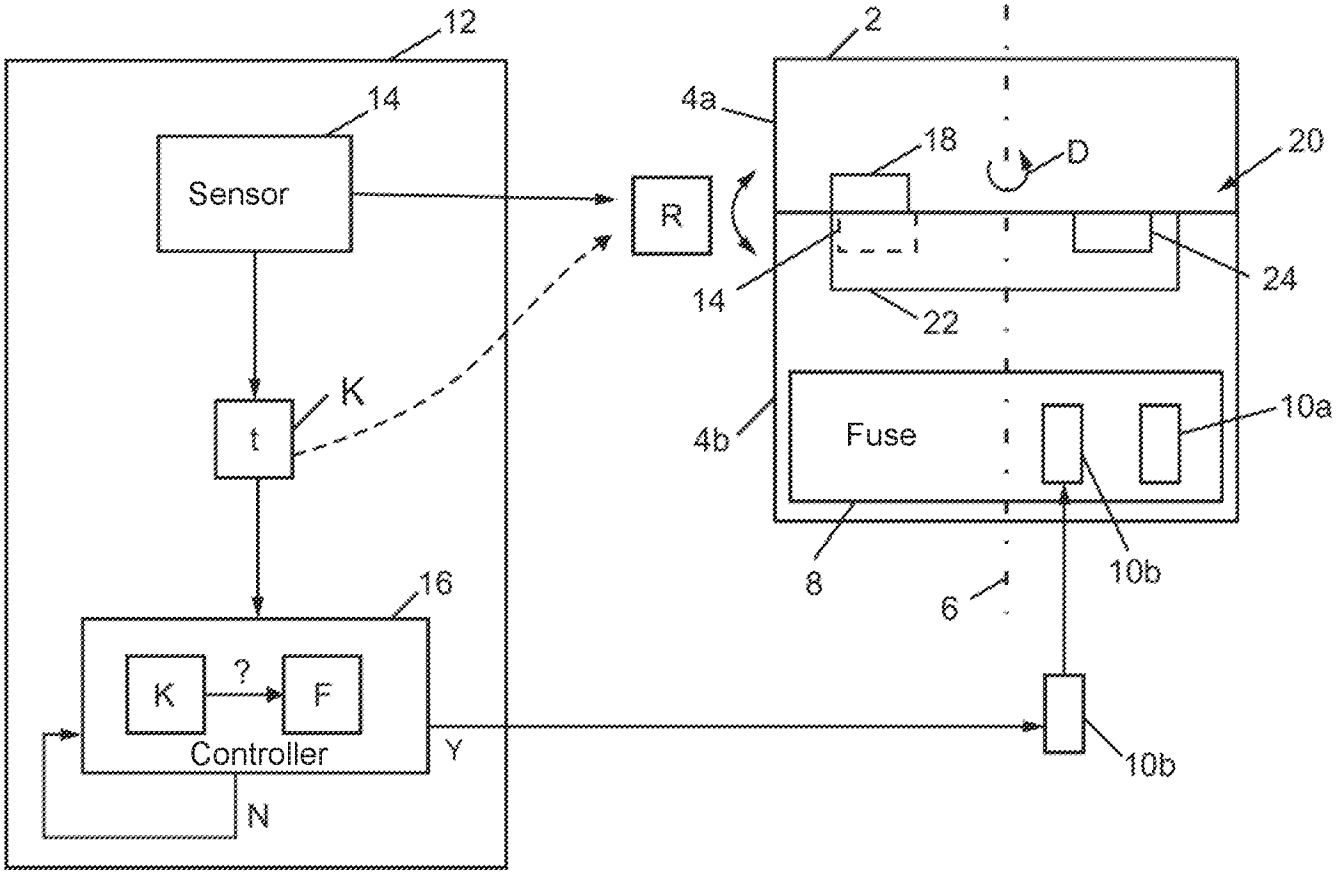
20
24
10a
10b
10b
D
18
22
2
Fuse
6
8
4a
14
4b
R
12
14
Sensor
K
t
16
Y
F
?
K
Controller
N

DEVICE FOR PRODUCING AN ARMING CRITERION, FUZE AND MUNITION

CROSS-REFERENCE TO RELATED APPLICATION

This application claims the priority, under 35 U.S.C. § 119, of German application DE 10 2018 004 510.3, filed Jun. 7, 2018; the prior application is herewith incorporated by reference in its entirety.

BACKGROUND OF THE INVENTION

Field of the Invention

The invention relates to a device for producing an arming criterion for a fuze for a partly spinning munition, which contains a first part, which has a spin about its central longitudinal axis during its flight as intended, and contains a second part, which at the same time has no motion or only a rolling motion less than the spin about the central longitudinal axis. The invention also relates to a corresponding fuze and a corresponding munition.

A partly spinning munition is known for example from German patent DE 103 41 713 B3. It describes a spin-stabilized artillery projectile with a projectile body and a projectile nose with a fuze, which contains a fuze housing and an inner fuze part. The fuze is supplied with electrical energy during the flight of the artillery projectile by a generator. The projectile nose is configured in such a way that it has with respect to the projectile body, which is spinning during flight, a lower rotational speed, different from the rotational speed of the spinning projectile body. The generator that supplies the fuze with electrical energy is driven by the relative rotational speed between the spinning projectile body and the decelerated projectile nose.

Also known from the document is the operating principle of a generator with a motor function when the nose is decoupled.

A safety device for a fuze is known for example from German patent DE 10 2007 054 777 B3, corresponding to U.S. Pat. No. 8,381,650. This is based on a safety device for a fuze, containing an explosive train and a primer with a barrier, which in its safe position is locked by a first safety device and a second safety device independent of the first, which are intended for an unlocking action on the basis of two physical arming parameters that are independent of one another. It is proposed that the explosive train contains a second primer and that the barrier blocks an intermediate space between the two primers in a safe position and can be brought into an armed position by a releasing movement that releases the intermediate space.

In other words, the operating principle and logic of a "MEMSAD" safety device (Micro-Electromechanic Safe and Arm Device) for a fuze is known from it.

SUMMARY OF THE INVENTION

The object of the invention is to provide improvements with respect to an arming criterion, a fuze and a munition.

The arming criterion is such a criterion that can be provided for a fuze or used in it in order to arm the fuze. In particular, the device is configured or specifically set up for a certain fuze or a certain type of fuze. The device is then one which, as intended, is to be used in or with a corresponding fuze, and consequently knows and uses the properties of the fuze. In particular, the arming criterion represents one of a number of arming criteria in a fuze, which must all be satisfied together in order to arm the fuze. The same applies correspondingly to the fuze: as intended, the fuze is such a fuze for a partly spinning munition. Such a munition contains a first part, which has a spin about the central longitudinal axis (direction of flight) of the munition during the flight as intended of the munition after firing. The munition contains a second part, which at the same time, that is to say during the flight, has no motion or only a rolling motion less than the spin about the central longitudinal axis. The number of revolutions of the rolling motion (for example 0 to 5 Hz) is therefore less than the number of revolutions of the spin (for example about 300 Hz).

The device includes a sensor. This serves for sensing a relative rotation (for example rotation present or not/rotational speed) or relative position (for example angle) about the central longitudinal axis between the first part and the second part of the munition. The sensor also serves for outputting a characteristic variable for the sensed relative rotation. The characteristic variable therefore reflects characteristic data of the relative rotation and is for example a rotational speed (Hz), an angle of rotation (degrees), an electrical voltage or current which, with respect to its amplitude, frequency, etc., provide an indication of the relative rotation or an important aspect of the relative rotation in terms of arming (for example "present or not", duration of the rotation).

The device includes a control device, which is connected to the sensor. The device serves inter alia for transmitting the characteristic variable. The control device is set up (for example by integration of a corresponding execution program, a hardwired logic, etc.) to only produce the arming criterion when the sensed characteristic variable fulfils a flying criterion.

In particular, as intended, the device is therefore designed for an overall system comprising a certain (type of) fuze and a certain munition (of a certain type), i.e. for being installed in it. Corresponding properties of the fuze/munition are therefore assumed to be known, i.e. the device is set up or designed for such properties.

A corresponding fuze is for example in principle the aforementioned fuze that is known from German patent DE 10 2007 054 777 B3. With respect to its first arming criterion (firing shock), this could then in principle remain unchanged. The invention could then provide the second arming criterion (originally from environmental criteria): the device according to the invention could be used for the second arming criterion in the correspondingly modified fuze as at least part of the control unit in combination with the sensor described there (electrical triggering of a pyrotechnic charge).

In the sense of the aforementioned suitability as intended, therefore, properties of the fuze and munition are described within the application even though the actual components are, strictly speaking, not part of the claimed subject matter but associated with the invention on the basis of a "lock and key principle". However, these statements also apply analogously to the fuze and munition according to the invention described further below, and may not be explicitly repeated again there.

The invention is based on the realization that for example guided munition is not fired with full spin. Therefore, the spin cannot be used (at least not directly if a corresponding arming device itself does not spin) as an arming criterion for a safe and arm unit (fuze). The object is therefore to find an arming criterion for a non-spinning (partly spinning) guided munition. "Non-spinning" should be understood here as meaning that the part in which the fuze or the device for producing the arming criterion is accommodated does not spin, but for example is rotationally at rest or only rolls (rolling: "spin" with rotational frequencies of for example less than 1, 3, 5, 10, 50, 100, . . . Hz).

The invention is also based on the realization that it is known from practice that guided munition is fired with reduced spin or with a low rolling rate from a weapons system with a rifled barrel. The reduction of the spin or low rolling rate is required in order to be able to intervene specifically in the trajectory on the basis of information concerning the orientation.

The invention is also based on the realization that an electronic system of a fuze (for example MEMSAD) requires two digital signals (0 or 1) on the channels of the arming criteria. For the first arming criterion, for example, a mechanical signal, to be specific the opening of a switch at a double-bolt system in response to the firing shock, is converted into an electronic or digital signal within the MEMSAD. For the second arming criterion—as known in practice—an environmental sensor board (data from the environment of the munition) or an external measured-value electronic system (measurement during the flight of the munition) is used to generate a digital signal, which clearly indicates a state during flight (i.e. can clearly distinguish whether or not the munition is actually in flight after being fired).

The invention is based on the idea that, when there is a spin-decoupled part (second part) of the munition, the relative movement between the fully spinning part (first part) and the unspun part (second part) can be used as a criterion for arming (arming criterion).

Since the two parts (which are for example part of a generator or include these parts) are fixed for firing and cannot be moved manually in such a way that a manual arming signal is created, the signal "relative movement present" from the sensor (in particular Hall sensor, see below) clearly indicates the state "projectile is on the trajectory (in flight after firing)", and consequently can be used for arming. At the same time, this is an environmental criterion (criterion from the environment of the munition) that is physically independent of the firing shock (if this is used as a further arming criterion), and consequently meets the requirements of the safety guideline STANAG 4187.

According to the invention, therefore (in particular due to the use of a Hall sensor, see below), the relative rotational or rolling motion of two munition parts is determined and this state is used as a criterion (in particular second criterion) for arming a safe and arm unit (fuze).

The invention offers in particular the advantage of a small installation space and a low-cost solution.

According to the invention, therefore, an arming criterion, in particular a second arming criterion, for a munition, in particular guided munition, is produced and a corresponding device is proposed.

In a preferred embodiment, the sensor s a contactlessly operating sensor. "Contactless" means that the sensor in the fitted state is in any event fitted on one of the parts and operates without contact with the other part. In particular, the sensor is fastened to a third part of the munition: in this case, it operates without contact with the first and second parts of the munition. Due to operating contactlessly, the sensor does not intervene in the other sequences of movement in the munition, or only minimally or imperceptibly.

In a preferred embodiment, the sensor is a magnetically operating sensor. It operates, in particular contactlessly, by means of the effect or sensing of magnetic fields. The sensor is in particular fitted in a (first, second, third, see above) part of the munition; another part then has a magnetic field, which at least for two different rotational positions of the sensor (Hall sensor, see below) is sensed differently by it, i.e. depending on the relative rotation is different or changing. In particular, there is a permanent magnet in the other part or the other parts. Due to the rotation, the magnetic field (or the magnet) is moved in relation to the sensor, which can then be sensed.

In a preferred variant of this embodiment, the sensor is a Hall sensor. Hall sensors are particularly inexpensive and commercially available. According to this variant of the invention, a standard component can be used for a safety-related application, to be specific the present device.

In a preferred embodiment, the flying criterion is the following condition, which is transformed into the characteristic variable: the condition is that a minimum number of revolutions between the first part and the second part has taken place and/or there is a minimum rotational frequency of the relative rotation. Transformed into the characteristic variable means that the fulfillment or nonfulfilment of the condition can be distinguished on the basis of the characteristic variable or its evaluation. The flying criterion should then be understood in connection with the characteristic variable during use as intended. For example, the characteristic variable is an output voltage of a Hall sensor. In the case where it is installed and used as intended, with every revolution between the first part and the second part it senses a positively or negatively directed magnetic field. Therefore, for a revolution, zero crossings are produced in the Hall voltage. The flying criterion is then the establishing of a minimum number of zero crossings of the voltage or the frequency of a variation over time of the voltage. The minimum number here may be less than one, one or a greater number of revolutions. The frequency is for example at least 50, 100, 150, 200, 250, or 300 Hz.

The object of the invention is also achieved by a fuze a partly spinning munition. The fuze and munition correspond to the above description in connection with the device according to the invention. The munition therefore contains a first part, which has a spin about its central longitudinal axis during its flight as intended, and contains a second part, which at the same time has no motion or only a rolling motion less than the spin about the central longitudinal axis. The fuze has at least one arming criterion, which must be satisfied in order to arm the fuze. The fuze includes a device according to the invention. The device provides the arming criterion as the arming criterion or one of the arming criteria of the fuze. The fuze, in particular as described above, is known in principle from German patent DE 10 2007 054 777 B3 and is modified according to the invention as explained above.

The fuze and at least some of its embodiments and also the respective advantages have already been explained analogously in connection with the device according to the invention.

In a preferred embodiment, the fuze has the arming criterion produced by the device as a first criterion. The fuze has a second arming criterion, which is based on a physical effect that is different from the relative rotation between the parts. The second criterion is based in particular on the firing shock of the munition when it is fired. Consequently, in particular the independence of the arming criteria that is required according to STANAG 4187 is fulfilled.

In a preferred embodiment, the sensor is at rest, at least in relation to the fuze, and is in particular fastened to the fuze. The fact that, as intended, the fuze is then fastened in the munition (in particular in a part of it) or is at rest there with respect to at least part of the munition, means that the sensor is fastened in the munition and can sense a corresponding relative movement between the two parts.

The object of the invention is also achieved by a munition as described above, which contains a first part, which has a spin about its central longitudinal axis during its flight as intended, and comprises a second part, which at the same time has no motion or only a rolling motion less than the spin about the central longitudinal axis. The munition includes a device according to the invention as described above. The sensor is consequently arranged or fastened correspondingly in the munition or is at rest in it or at least in part of the munition. A corresponding munition in the sense of the invention is in particular also a munition part, for example a 2D guided module with a decoupled nose or a guided munition with a decoupled tail.

The munition and at least some of its embodiments and also the respective advantages have already been explained analogously in connection with the fuze according to the invention and/or the device according to the invention.

In a preferred embodiment, the munition includes a fuze according to the invention as already described above.

In a preferred embodiment, the sensor and/or the control device of the device and/or the fuze are arranged in the second part of the munition. Consequently, the corresponding components do not undergo any rotation, or only a rolling motion.

In a preferred embodiment, the sensor is a magnetic sensor, which is fastened in one of the parts (the first or second part). In the other of the parts (the second or first part), a magnetic field source for a time-constant magnetic field is fitted. The magnetic field is sensed by the sensor in at least a first rotational position. In at least a second rotational position, no magnetic field or a changed magnetic field is sensed. It is thus ensured that the sensor can sense or distinguish individual rotational positions, and consequently also the rotation between the two parts. Due to the fitting (at rest) in one part, the sensor thus also reproduces the direct relative movement in relation to the other part.

In a preferred variant of this embodiment, the magnetic field source includes at least one permanent magnet or is such a permanent magnet. This leads to a particularly simple and reliable embodiment of the munition.

In a preferred variant of this embodiment, the magnetic field source is that of a generator and/or motor divided in a two-component manner into the first part and the second part. "In a two-component manner" means that a first part of the motor/generator is fastened or at rest in one part of the munition (for example a stator) and a second part (for example rotor) is fastened or at rest in the second part of the munition, Due to the relative rotation, the parts of the motor/generator are then turned in relation to one another. A corresponding munition with a generator/motor is known in principle, for example from German patent DE 103 41 713 B3, as explained above. In this respect, it is based on the realization that such a generator at the decoupling point in the munition (between the first part and the second part) makes use of the relative movement of the coupled munition parts, for example the projectile body and the fuze nose or projectile body and tail, for generating energy. In order to use this generator at the same time as a motor, Hall sensors for example are in any case used. In this way, the decoupled part can be turned into a certain position or phase position with respect to the spinning part by means of a control algorithm. Hall sensors do not have a great installation volume, so it is quite possible for a second Hall sensor to be used (as a sensor of the device) at this interface, from which then a signal for arming can be derived from the relative movement. A second Hall sensor is therefore used, in order not to couple the arming criterion of the explosive train with the control algorithms for influencing the flight path.

In a preferred variant of this embodiment, the device according to the invention therefore contains a first Hall sensor as the sensor and the generator and/or the motor comprises a second magnetic field sensor as the Hall sensor.

Other features which are considered as characteristic for the invention are set forth in the appended claims.

Although the invention is illustrated and described herein as embodied in Device for producing an arming criterion, a fuze and a munition, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The single FIGURE of the drawing is a block diagram of a munition with a fuze with a device according to the invention.

DETAILED DESCRIPTION OF THE INVENTION

Referring now to the single FIGURE of the drawing in detail, there is shown a partly spinning munition 2, which contains a first part 4*a* and a second part 4*b*. The FIGURE shows the munition 2 after it has been fired, i.e. during flight in the direction of a target that is not shown.

As intended, the first part 4*a* in this case has a spin D about a central longitudinal axis 6 of the munition 2. The munition flies in the direction of the central longitudinal axis 6. According to the spin D, the first part 4*a* rotates with 300 revolutions per second (Hz) about the central longitudinal axis 6. By contrast, the second part 4*b* is rotationally at rest, i.e. does not undergo any rotation about the central longitudinal axis 6. Consequently, the first part 4*a* and the second part 4*b* rotate in a relative rotation R (indicated by a double-headed arrow) in relation to one another, here at 300 Hz, about the central longitudinal axis 6.

A fuze 8 is included in the second part 4*b* of the munition 2, in order to detonate the munition at a suitable point in time that is not explained any more specifically here. This only takes place however when the fuze has been armed. The fulfillment of two criteria 10*a*, 10*b* is necessary for this. The first arming criterion 10*a* is already provided in the flight shown, since it was produced during the firing of the munition 2.

For producing the second arming criterion 10*b*, the fuze 8 includes a device 12, which for purposes of illustration is shown outside the fuze 8 in the FIGURE. The device 12 includes a sensor 14 (for purposes of illustration also indicated by dashed lines in the part 4*b*), which senses the relative rotation R between the first part 4*a* and the second part 4*b* about the central longitudinal axis 6. The sensor 14 is fitted fixedly in the part 4*b* and outputs a characteristic variable K, which reflects the relative rotation R. In the example, the sensor 14 is a contactlessly and magnetically operating Hall sensor. The sensor 14 senses a magnetic field, dependent on the angle of rotation, of a magnetic field source 18, which is fixedly fitted in the part 4*a*.

The characteristic variable K is the Hall voltage emitted by the sensor 14 or its variation over time t. In the example, the sensor system is configured in such a way that, when there is a relative rotation R in the form of a single revolution, a sinusoidal oscillation of the Hall voltage is obtained. The sensor 14 is in this case fastened fixedly on the fuze 8. The sensor 14, the control unit 16 and the entire fuze 8 are consequently arranged in the second part 4*b* of the munition 2, or fixedly fastened in it.

In order to form a corresponding sensor system, the magnetic field source 18, here a permanent magnet, is fixedly fitted in the first part 4*a* of the munition 2. The magnetic field source 18 generates a time-constant magnetic field. When there is a rotation or relative rotation R, the magnetic field source 18 generates a varying magnetic field in the sensor 14. The magnetic field at that time or the corresponding change is reflected in the characteristic variable K or its variation over time t.

The magnetic field source 18 is part of a generator 20 of the munition 2, which is arranged distributed in the first part 4*a* and the second part 4*b* of the munition 2. For this, the generator 20 includes a counterpart 22 that is not explained any more specifically, here a coil arrangement, in the second part 4*b*. The generator 20 may also be operated as a motor. In order to realize a corresponding control of the motor, a further magnetic field sensor 24, here likewise a Hall sensor, is provided, likewise acting together with the magnetic field source 18 in order to accomplish a control of the relative position between the first part 4*a* and the second part 4*b* of the munition 2 in a way not explained any more specifically. In the present case, with a given spin D of the first part 4*a*, the second part 4*b* is thereby controlled in such a way that it remains at rest with respect to rotation about the central longitudinal axis 6.

The device 12 also includes a control unit 16. This is set up or configured as follows by electronic components or corresponding programming not explained any more specifically.

The control unit 16 monitors the characteristic variable K for a flying criterion F. As long as it is not satisfied ("N"), the monitoring is continued; as soon as it is satisfied ("Y"), the arming criterion 10*b* is produced.

The flying criterion F is devised in such a way that it is only fulfilled after firing, during the flight of the munition 2. In the present case, the flying criterion F contains that in the characteristic variable K over the time t there is an alternating signal with a frequency of at least 250 Hz for at least 1 second. This condition is satisfied a good 1 second after the firing of the munition 2, since the spin D, and consequently the frequency of the characteristic variable K, increases from 0 Hz to 300 Hz after firing until it leaves the barrel and during flight remains in any event above 250 Hz. The delay of 1 second provides corresponding fore-bore safety.

The following is a summary list of reference numerals and the corresponding structure used in the above description of the invention:

2 Munition
4*a*, 4*b* First part, second part
6 Central longitudinal axis
8 Fuze
10*a*, 10*b* Arming criterion
12 Device
14 Sensor (Hall sensor)
16 Control unit
18 Magnetic field source
20 Generator
22 Counterpart
24 Magnetic field sensor (Hall sensor)
D Spin
R Relative rotation
t Time
K Characteristic variable
F Flying criterion

The invention claimed is:

1. A device for producing an arming criterion for a fuze for a partly spinning munition, the partly spinning munition having a first part which spins about a central longitudinal axis during its flight and a second part which at a same time has no motion or only a rolling motion less than a spin about the central longitudinal axis, the device comprising:

a sensor for sensing a relative rotation about the central longitudinal axis between the first part and the second part of the partly spinning munition and for outputting a characteristic variable for the relative rotation sensed; and a control unit connected to said sensor and set up to only produce the arming criterion when the characteristic variable fulfils a flying criterion.

2. The device according to claim 1, wherein said sensor is a contactlessly operating sensor.

3. The device according to claim 1, wherein said sensor is a magnetically operating sensor.

4. The device according to claim 3, wherein said sensor is a Hall sensor.

5. The device according to claim 1, wherein the flying criterion is a condition, derived from the characteristic variable, where a minimum number of revolutions between the first part and the second part has taken place and/or there is a minimum rotational frequency of the relative rotation.

6. A fuze for a partly spinning munition, the partly spinning munition having a first part spinning about a central longitudinal axis during flight and a second part, which at a same time has no motion or only a rolling motion less than the spinning about the central longitudinal axis, the fuze comprising:

a device containing:

a sensor for sensing a relative rotation about the central longitudinal axis between the first part and the second part of the partly spinning munition and for outputting a characteristic variable for the relative rotation sensed; and a control unit connected to said sensor and set up to only produce an arming criterion when the characteristic variable fulfils a flying criterion; and said device providing the arming criterion as one of the arming criteria of the fuze.

7. The fuze according to claim 6, wherein the arming criterion produced by said device is a first criterion and the fuze has a second arming criterion, which is based on a physical effect that is different from the relative rotation between the first and second parts.

8. The fuze according to claim 6, wherein said sensor is fastened to the fuze.

9. A munition, comprising:

a first part having a central longitudinal axis and spinning about said central longitudinal axis during flight;

a second part at a same time having no motion or only a rolling motion less than the spinning about said central longitudinal axis;

a device containing:

a sensor for sensing a relative rotation about said central longitudinal axis between said first part and said second part and for outputting a characteristic variable for the relative rotation sensed; and a control unit connected to said sensor and set up to only produce an arming criterion when the characteristic variable fulfils a flying criterion.

10. The munition according to claim 9, further comprising a fuze receiving the arming criterion from said device as one of a plurality of arming criteria of said fuze.

11. The munition according to claim 9, wherein at least one of said sensor, said control unit or said fuze is disposed in said second part.

12. The munition according to claim 9, further comprising a magnetic field source; and wherein said sensor is a magnetic sensor fastened in one of said first and second parts, and in the other of said first and second parts said magnetic field source for a time-constant magnetic field is fitted.

13. The munition according to claim 12, wherein said magnetic field source includes at least one permanent magnet.

14. The munition according to claim 12, further comprising a machine selected from the group consisting of a generator and a motor, said magnetic field source is a part of said machine and said machine is divided in a two-component manner into said first part and said second part.

15. The munition according to claim 14, wherein said device has a first Hall sensor as said sensor and said machine has a magnetic field sensor as a second Hall sensor.

* * * * *